US005372353A

United States Patent [19]

West

[11] Patent Number: 5,372,353

[45] Date of Patent: Dec. 13, 1994

[54] TRUCK TRANSMISSION JACK

[76] Inventor: Shelby J. West, 1110 Vegas, Garland, Tex. 75042

[21] Appl. No.: 91,920

[22] Filed: Jul. 14, 1993

[51] Int. Cl.[5] ..... B66F 5/04

[52] U.S. Cl. ..... 254/10 B; 254/134; 254/DIG. 16

[58] Field of Search ..... 254/7 B, 7 R, 8 B, 9 B, 254/9 R, 10 B, 10 R, 124, 134, DIG. 16

[56] References Cited

U.S. PATENT DOCUMENTS

| | | | |
|---|---|---|---|
| 2,575,485 | 11/1951 | Bramble | 254/8 B |
| 2,906,497 | 9/1959 | Wolf | 254/10 B |
| 2,940,611 | 6/1960 | Burch | 254/DIG. 16 |
| 3,958,793 | 5/1976 | Garate | 254/10 B |
| 4,269,394 | 5/1981 | Gray | 254/134 |
| 4,549,722 | 10/1985 | Gagliano | 254/DIG. 16 |
| 5,190,265 | 3/1993 | Barry et al. | 254/8 B |

*Primary Examiner*—Robert C. Watson
*Attorney, Agent, or Firm*—Cahill, Sutton & Thomas

[57] ABSTRACT

A truck transmission jack includes a wheeled base to allow the jack to be moved in position below a transmission, gear box, or the like. A cradle is supported upon the wheeled base for engaging and supporting the underside of a transmission or gear box. The cradle is supported by three support arms, each being pivotally coupled to the wheeled base at one end of each support arm and pivotally coupled to the cradle at the opposing end of each support arm. All of the support arms are parallel to one another for maintaining the cradle in a relatively horizontal position as the support arms pivot. Two of the support arms are elevating arms having coaxial pivot points and extend from opposing sides of the wheeled base. A hydraulic jack rests upon the wheeled base between the elevating arms and includes a piston rod extendable upwardly for raising a yoke that is pivotally coupled to the elevating arms in order to raise the cradle. Adjustable support bars are provided at each end of the cradle to match the contour of the transmission being supported. A sliding support bar and associated collar are releasably clamped to a side of the cradle to position a locator bolt at a desired location.

16 Claims, 2 Drawing Sheets

TRUCK TRANSMISSION JACK

BACKGROUND OF THE INVENTION

1. Field of the Invention

The present invention relates generally to apparatus for lifting and supporting truck transmissions, gear boxes, and differentials during servicing and repairs, and more particularly, to a truck transmission jack with improved safety and maneuverability.

2. Description of the Relevant Art

Truck transmissions, gear boxes, and differential gear assemblies routinely require servicing. In most cases, such servicing is most efficiently performed by removing the transmission, gear box, or the like, from the truck. Such components typically weigh from 350 to 800 pounds on large trucks, and service personnel require the assistance of a jack to support, lower, and raise, such components in order to remove such components from the truck, and to reinstall such components upon the truck.

Some transmission jacks that are already available are incapable of assuming a low profile near the ground even when collapsed. Such jacks are sometimes difficult to use because they are not easily positioned below the truck, particularly for trucks having low ground clearance. In such cases, the mechanic may actually need to elevate the truck in order to create sufficient ground clearance to insert the jack in position below the truck.

Other transmission jacks that are known may be configured in a relatively compact profile when collapsed, but are incapable of being raised very far off the ground. Such jacks may not have sufficient height to reach the transmission, gear box, or other component to be removed, at least not without inserting wood blocks or other spacers atop the jack and below the component to be removed. However, the need to insert such spacers poses an inconvenience, as well as a safety risk if such spacers shift out of position.

Moreover, many transmission jacks which have been made commercially available, and which have sufficient range of elevation, often become unbalanced and/or unstable when the load is supported at an elevated position. In particular, the load may be supported too close to one end of the jack and tip the jack over or, alternatively, the load may twist or rotate while in an elevated position, potentially causing physical injury to the repairman and further damage to the removed component.

Other transmission jacks which are known to the present applicant typically include hydraulic lifting mechanisms which are built into the transmission jack, often extending horizontally in order to lower the profile of the apparatus. If the hydraulic lifting mechanism fails and can not be repaired, the user must go to the expense of replacing the entire truck transmission jack. Moreover, positioning the hydraulic cylinder horizontally accelerates leakage of hydraulic fluid out of the hydraulic lifting mechanism.

Yet another problem with existing truck transmission jacks is that truck transmissions and gear boxes come in a wide variety of shapes and sizes, yet many existing truck transmission jacks are not easily adjusted to properly support the load in accordance with the particular contour of a specific truck transmission.

Various forms of mobile lifting jacks have been described in previously issued patents. For example, in U.S. Pat. No. 2,621,891 to Marsh, a mobile jack unit is described including a wheeled base, a scissors jack controlled by a threaded draw screw, and a platform for raising and lowering a rear axle differential housing or other load.

U.S. Pat. No. 2,838,278 to Johnsen discloses a transmission jack and a clamping assembly for use therewith in order to adjust for different sizes and makes of transmission housings.

In U.S. Pat. No. 2,940,611 to Burch, an automobile transmission dolly is described for handling truck transmissions. The dolly includes a wheeled base, a pair of lifting arms, a vertical lifting jack for raising the lifting arms, a cradle support, and a cradle for receiving a transmission; a further jacking device is provided for moving the cradle upon the cradle support. The upper end of the vertical jack is coupled to a bridge which is, in turn, coupled to the lifting arms for transmitting a lifting force thereto.

U.S. Pat. No. 2,938,635 to Dyer discloses a wheeled floor jack for removing engines from vehicles. The jack is raised and lowered by operating a handwheel for turning a rotatable screw.

In U.S. Pat. No. 3,109,626 to Arnes et al., a truck transmission jack is described including a tubular base supported by casters. A lifting platform is carried by a pair of lifting beams and a pair of parallel links. A lifting screw is mounted to the base and passes through a nut carried by the lifting beams. A handwheel is operated by the user to turn the lifting screw in order to raise and lower the lifting platform. The lack of hydraulics, and the necessity for turning a handwheel mounted well above the ground make operation of such a device difficult.

U.S. Pat. No. 3,136,526 to Wolf discloses one example of a prior art hydraulic jack mechanism for use under a vehicle to remove transmissions and the like. The Wolf apparatus uses two pairs of support arms which generally extend parallel to one another. However, the apparatus disclosed by Wolf positions the hydraulic piston horizontally; while helping to minimize the profile of the jack when collapsed, the horizontally extending piston and cylinder promote hydraulic fluid leakage. In addition, the Wolf hydraulic ram must be attached at both of its ends to the lifting assembly, making replacement of the hydraulic ram inconvenient. While a handle is provided at one end of the jack assembly, the handle obstructs access to the pump lever of the hydraulic ram. Moreover, the relatively flat, planar platform provided by Wolf to support the transmission is not easily adjusted to support a wide variety of transmissions and other components.

In U.S. Pat. No. 3,559,981 issued to Abshear, an apparatus is shown for removing differentials from vehicles. The apparatus is supported upon a conventional wheeled floor jack.

U.S. Pat. No. 3,958,793 to Garate also discloses a transmission jack for raising and lowering transmissions and the like. A ratchet mechanism prevents the jack from lowering completely to the ground in the event of an inadvertent release of hydraulic pressure. The hydraulic ram is again mounted horizontally, accelerating leakage of hydraulic fluid. In addition, the hydraulic ram requires a mounting block and mounting bolts for being secured horizontally within the apparatus, making replacement of the hydraulic ram more difficult. Like the Wolf jack assembly, the Garate device is provided with a handle at one end of the jack assembly which generally obstructs access to the pump lever of the hydraulic ram. Further, the Garate device uses a pair of chains below the transmission to form a cradle, and a chain which extends over and around the top of the transmission in order to support the transmission, rather than providing rigid supports for positively supporting the underside of the transmission.

U.S. Pat. No. 4,269,394 issued to Gray also discloses a truck transmission jack assembly. Once again, the hydraulic cylinder disclosed by Gray extends horizontally, rather than vertically, and the hydraulic cylinder must be attached to the lifting linkage. No handles are provided as would assist the user in properly positioning the jack assembly below the truck.

In U.S. Pat. No. 4,570,905 to Gerstner, a floor jack assembly for removing auto differentials is disclosed wherein a conventional wheeled floor jack is provided with a platform for supporting differentials. The platform includes a flange which supports a pair of arms each provided with a post adapted to be inserted through a bolt-receiving opening of a differential housing.

U.S. Pat. No. 4,899,985 to Good discloses a castered low profile lift device incorporating a hydraulic bottle jack for raising and lowering a lift head. However, the lift head is raised and lowered by a single lift arm which is subject to lateral sway, as well as tilting at higher elevations.

While many of the jacking devices described above employ pivoting parallelogram structures to maintain the lifting cradle relatively horizontal, the parallel arms which form the parallelogram are typically positioned closely adjacent to one another. Indeed, in many cases, both of the arms forming the parallelogram are pivotally secured to the base at pivot points that are closely adjacent to one end of the base. As the load is raised, the center of gravity of the combined jack and load comes dangerously close to one end of the base. The present applicant has found that greater stability is achieved when the arms forming the pivoting parallelogram are spaced further apart from one another.

Accordingly, it is an object of the present invention to provide a truck transmission jack which is capable of assuming a relatively low profile near the ground when collapsed while being capable of being elevated to an extended height without becoming unbalanced or unstable.

It is another object of the present invention to provide such a truck transmission jack which allows a user to safely and easily support truck transmissions, gear boxes, and the like, without fear that the supported component will twist, rotate, and/or fall off of the jack and injure the user.

It is yet another object of the present invention to provide such a truck transmission jack that is adapted to use a lifting mechanism for raising and lowering the supporting cradle of the jack, wherein the lifting mechanism is easily replaceable at relatively little cost in the event that the hydraulic lifting mechanism should fail.

Still another object of the present invention is to provide such a truck transmission jack which is easily adjusted to fit and safely support the contour of a wide variety truck transmissions, gear boxes, and the like.

A further object of the present invention is to provide such a transmission jack which is capable of supporting and maintaining the load in an elevated position for servicing without maintaining pressure upon the hydraulic lifting system of the jack.

A yet further object of the present invention is to provide such a transmission jack wherein the supporting arms that support the lifting cradle are spaced sufficiently far apart from one another to evenly distribute the weight of the load across the base and to provide a stable support for the lifting cradle.

A still further object of the present invention is to provide such a truck transmission jack which is strong, sturdy, safe, easily operated, and inexpensive to manufacture.

These and other objects of the present invention will become more apparent to those of skill in the art as the description of the present invention proceeds.

SUMMARY OF THE INVENTION

Briefly described, and in accordance with a preferred embodiment thereof, the present invention relates to a lifting device for supporting transmissions, gear boxes, differentials, and the like, and including a wheeled base for allowing the lifting device to be moved into a desired position under a vehicle. The device includes a cradle supported by the wheeled base and adapted to be raised and lowered for engaging and supporting the underside of a transmission, gear box, or the like. First and second support arms extend parallel to each other along opposing sides of the base and are pivotally coupled at their first ends to the base along a first pivot axis. The opposing second ends of the first and second support arms are pivotally coupled to the cradle along a second pivot axis.

A hydraulic jack is supported in an upright, vertical position upon the base, and includes a piston rod selectively extendable upwardly therefrom. A lifting member, which may be in the form of a yoke, is engaged by the piston rod for being raised and lowered thereby. The lifting member is pivotally coupled to both the first and second support arms along a third pivot axis located generally between the first pivot axis and the second pivot axis.

A third support arm is provided to help transfer and distribute the weight supported by the cradle, and to help maintain the cradle in a generally horizontal position. The third support arm extends generally parallel to, but spaced apart from, the first and second support arms. A first end of the third support arm is pivotally coupled to the base along a fourth pivot axis, and the opposing second end of the third support arm is pivotally coupled to the cradle along a fifth pivot axis. To enhance the stability of the lifting device, the fourth pivot axis of the third support arm is spaced apart from the first pivot axis of the first and second support arms. Moreover, the first and fourth pivot axes are positioned on opposite sides of the third pivot axis, where the lifting force is applied, to more evenly distribute the weight born by the cradle across the wheeled base. Preferably, the third support arm pivots through a vertical plane that is centered between the first and second support arms.

Within the preferred embodiment of the present invention, the hydraulic jack is a conventional, inexpensive, manually-operated bottle jack. The lifting member is preferably in the form of a yoke that includes an upper horizontal member for being engaged by the piston rod, and including two opposing downwardly depending side members extending along opposing sides of the bottle jack. The lower ends of the downwardly depending side members are pivotally coupled to the first and second support arms along the third pivotal axis. The bottle jack is removably placed between the wheeled base and the upper horizontal member of the yoke, and is easily removed for service or replacement.

The lifting device of the present invention allows the first, second, and third support arms to fall under the force of gravity to a substantially horizontal position when the hydraulic jack piston rod is retracted in order to permit the lifting device to assume a low profile when collapsed.

In order to safely support a wide variety of transmissions, gear boxes and the like, the cradle of the lifting device includes a generally rectangular frame having first and second opposing side members and first and second opposing end members. The aforementioned first and second support arms are pivotally coupled to the first and second opposing side members, respectively, along the second pivotal axis. The cradle preferably includes a first support bar secured above the first end member and a second support bar secured above the second end member; each of the first and second support bars are adjustable in height relative to their respective end members in order to adapt to transmissions or gear boxes of different shapes and sizes. At least one of the support bars may advantageously include holes formed therein for receiving locating pins used to help support a transmission or gear box.

Apart from the support provided by the first and second support bars, the central portion of the load can also be supported by including an additional support bar that is slidingly supported from one of the side members of the cradle. The sliding support bar may be used to support a locator bolt for assisting in the support of a transmission or gear box. The sliding support bar preferably includes a plurality of spaced holes formed therein for supporting the locator bolt at a number of different positions along the sliding support bar. In order to facilitate sliding movement of the sliding support bar along the side member of the cradle, a collar extends about and is slidingly engaged with a side member of the cradle. The collar may include a clamp bolt for selectively locking the collar against further sliding movement along the side member of the cradle.

The cradle is easily adapted to support rear end differentials by securing one or more fastening arms to the cradle. Each fastening arm has a hole formed therein for receiving a bolt used to releasably secure a differential casing, or other truck component, to the cradle.

The preferred embodiment of the present invention includes handles secured to opposing ends of the wheeled base for allowing a user to easily position the lifting device at a desired location below the truck and/or to pull the lifting device away from the vehicle after the component to be serviced has been removed. As indicated above, the hydraulic jack is preferably a conventional bottle jack, which includes a pump lever extending from a peripheral portion of the wheeled base for allowing a user to pump hydraulic fluid in order to extend the piston rod for raising the cradle. While a handle is preferably secured to the wheeled base proximate the hydraulic jack, such handle is spaced apart from the pump lever of the hydraulic jack to avoid interference with the operation of the pump lever by the user.

DETAILED DESCRIPTION OF THE PREFERRED EMBODIMENT

Figure 1:
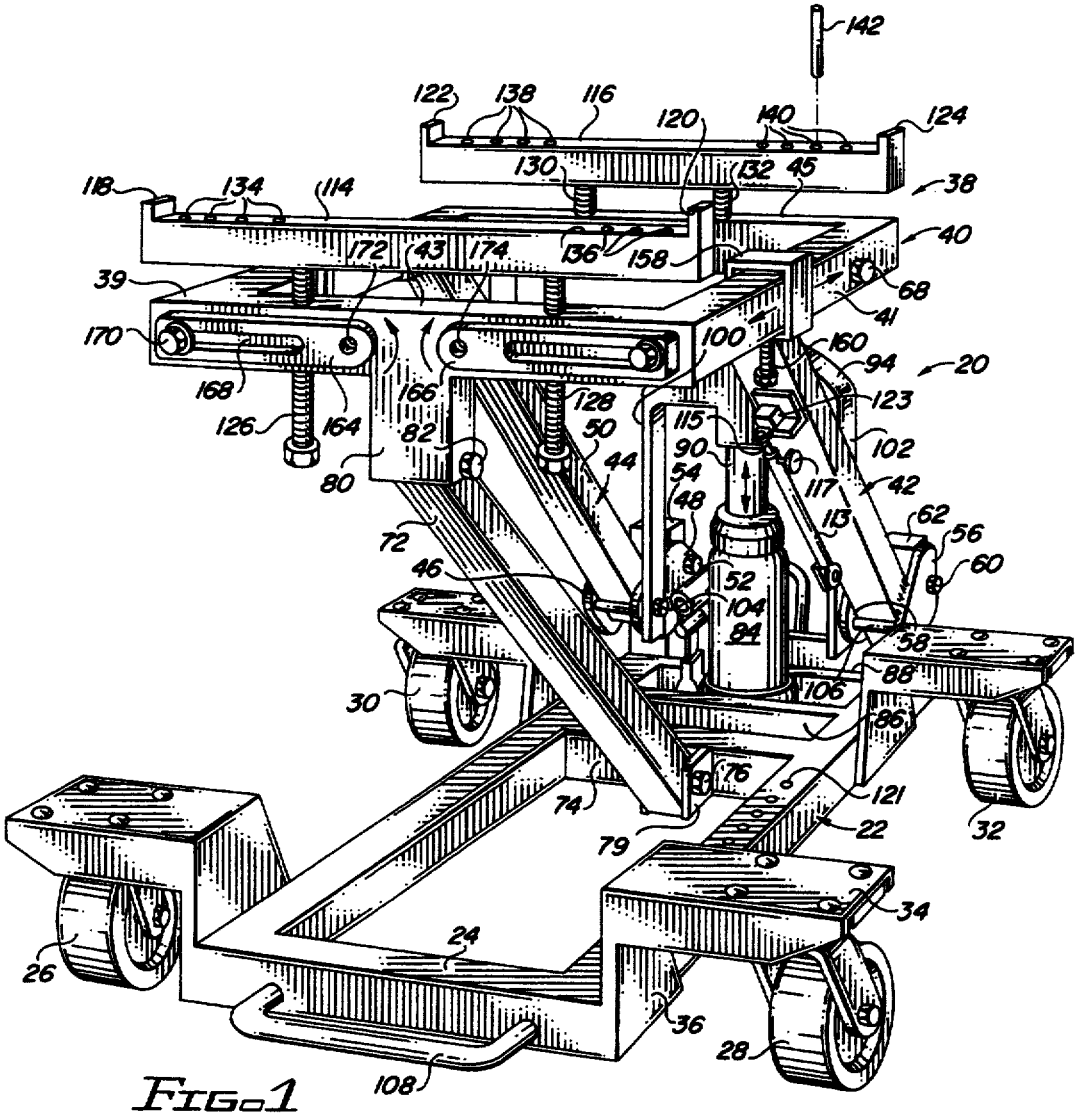
FIG. 1 is a perspective view of a truck transmission jack embodying the present invention, and wherein the cradle is elevated to a raised position.
Figure 2:
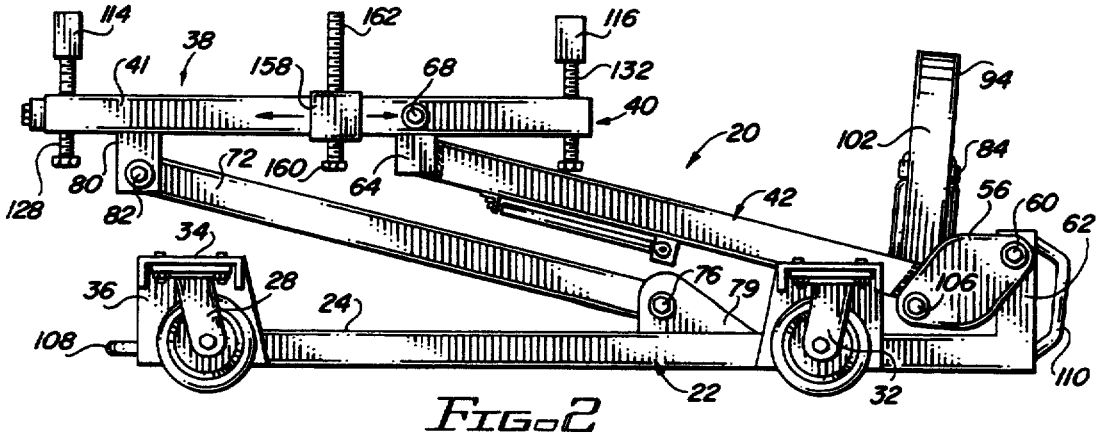
FIG. 2 is a side view of the truck transmission jack shown in FIG. 1 after the cradle has been lowered.
Figure 3:
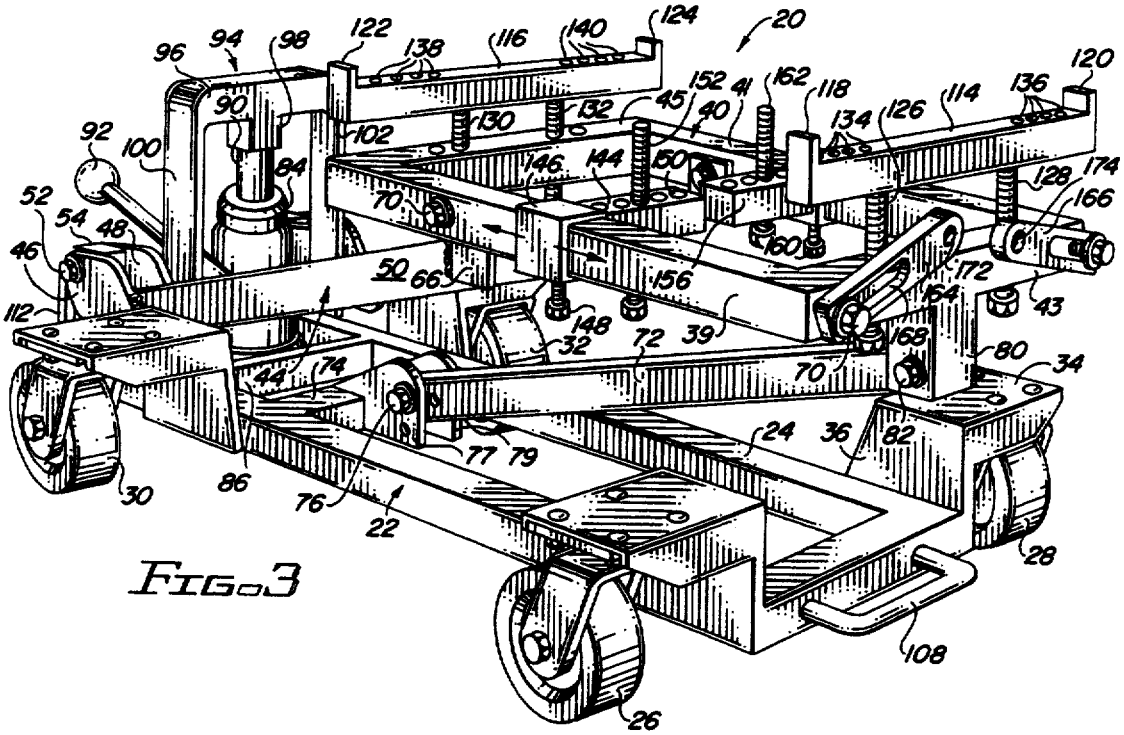
FIG. 3 is a perspective view of the truck transmission jack shown in FIG. 2.

Referring collectively to FIGS. 1–3, a lifting device in the form of a truck transmission jack is designated generally by reference numeral 20. Jack 20 is adapted to be used for supporting transmissions and gear boxes of trucks and other vehicles, including removal and installation of transmissions, rearends, and gearboxes for large, eighteen-wheel trucks.

Jack 20 includes a wheeled base 22 for allowing jack 20 to be moved into a desired position under a vehicle (not shown). Wheeled base 22 includes a generally rectangular frame 24 formed of two-inch square by ¼-inch thick steel tubing welded at the corners for structural strength. In the preferred embodiment, frame 24 measures approximately 14 inches wide by 42 inches long. Frame 24 is supported only one or two inches off the ground to permit clearance over hoses and tools while minimizing the collapsed height of jack 20. The wheeled base 22 also includes four ball bearing caster wheels 26, 28, 30 and 32 having neoprene tires supported in steel frames. Each of wheels 26–32 is capable of swivelling 360 degrees, thereby permitting mobility in any direction. Each of wheels 26–32 is preferably rated at 600 pounds capacity in order to support heavy loads. Moreover, because such wheels have neoprene tires, rather than conventional steel caster wheels, jack 20 can more easily be maneuvered over debris, hoses, or irregularities in the surface on which jack 20 is supported, even when under load.

Wheels 26–32 are preferably arranged to provide a 27-inch wide wheel track, and a 33-inch long wheel base, in order to provide a highly stable, yet easily maneuverable transmission jack. It will be noted that caster wheels 30 and 32 are spaced a short distance from the end of frame 24, which explains why the wheel base is slightly shorter than the length of frame 24. Each caster wheel is secured by four carriage bolts to an overlying inverted U-shaped steel channel member, such as channel member 34 to which caster wheel 28 is attached. In turn, each channel member is welded to the upper end of a one-half inch thick vertical plate, the lower end of which is welded to rectangular frame 24; for example, channel member 34 is welded to the upper end of vertical plate 36. This form of construction provides a strong attachment of caster wheels 26–32 to frame 24 while maintaining frame 24 relatively close to the ground to minimize the profile thereof.

Jack 20 also includes a cradle 38 for engaging and supporting the underside of a transmission or gear box. Cradle 38 includes a generally rectangular frame 40 formed of two-inch square by ¼-inch thick steel tubing welded at the corners to provide a strong support for heavy loads. In the preferred embodiment, frame 40 measures approximately 19 inches wide by 24 inches long. Frame 40 includes a pair of opposing side members 39 and 41, as well as opposing end members 43 and 45. Cradle 38 includes additional components secured to frame 40, the nature of which will be described in greater detail below. Still referring to FIGS. 1–3, jack 20 includes first and second support arms 42 and 44 which generally extend parallel to each other generally along opposing sides of frame 24. Each of support arms 42 and 44 is formed primarily of two-inch square by ¼-inch thick steel tubing. Each of support arms 42 and 44 has a lower end that is formed by two opposing parallel diamond-shaped vertical plates welded to opposing faces of the lower end of the aforementioned square tubing. For example, referring to FIG. 3, support arm 44 includes a pair of opposing diamond shaped steel plates 46 and 48 welded to opposing faces of the lower end of square steel tube 50. Support arm 44 is pivotally coupled to wheeled base 22 along a first pivot axis coincident with attachment bolt 52 visible in FIG. 3.

More specifically, bolt 52 pivotally couples vertical plates 46 and 48 to a section of square tubing 54 extending upright from, and welded to, a rear corner of frame 24. Likewise, vertical plates 56 and 58 welded to opposing faces of support arm 42 are pivotally coupled by bolt 60 to a section of square tubing 62 extending vertically from the opposing rear corner of frame 24. Pivot bolts 52 and 60 extend along a common pivot axis.

The upper end of support arm 42 includes a vertically-directed plate 64 (see FIG. 2) welded to the upper end thereof. Likewise, the upper end of support arm 44 includes a vertically-directed plate 66 (see FIG. 3) welded to the upper end of square tube 50. A bolt and nut assembly 68 extends through aligned holes formed in plate 64 and side member 41 of frame 40 to pivotally couple the upper end of support arm 42 to one side of cradle 38. Likewise, bolt and nut assembly 70 pivotally couples the upper end of support arm 44 to the opposing side member 39 of cradle 38. Bolt assemblies 68 and 70 extend along a common pivot axis.

Jack 20 includes a third support arm 72, which may also be formed of square steel tubing. The lower end of third support arm 72 is pivotally coupled to wheeled base 22. More 8 specifically, the lower end of third support arm 72 has a hole extending through both opposing side walls thereof; a cross bar 74 formed of square steel tubing is welded to the sides of frame 24, and a pair of spaced vertical plates 77 and 79 are welded to cross bar 74 to form a hinge with the lower end of third support arm 72 centered between the sides of frame 24. A pivot bolt and nut assembly 76 extends horizontally through holes formed in hinge plates 77 and 79 aligned with the holes formed in the lower end of support arm 72 to form a pivotal connection along a pivot axis coincident with bolt and nut assembly 76. It should be noted that this pivot axis is generally centrally located along the length of frame 24, whereas the pivot axis for support arms 42 and 44, corresponding to pivot bolts 52 and 60, is located at one end of frame 24. It will also be appreciated that third support arm 72 rotates through a plane that is substantially centered between first and second support arms 42 and 44.

The upper end of third support arm 72 is pivotally coupled to cradle 38. More specifically, frame 40 includes a vertically extending, U-shaped channel member 80 welded at its upper end to the forwardmost end of frame 40, and wherein channel member 80 opens toward the rear. Bolt and nut assembly 82 extends horizontally through aligned holes formed in the upper end of third support arm 72 and through the sides of channel member 80 to form a pivotal connection between the upper end of support arm 72 and cradle 38, and having a pivot axis coincident with bolt and nut assembly 82.

Those skilled in the art will appreciate that third support arm 72 extends substantially parallel to first and second support arms 42 and 44 even when cradle 38 is raised or lowered. Accordingly, support arms 42, 44 and 72 form a parallelogram structure which maintains cradle 38 essentially horizontal irrespective of the elevation of cradle 38. It will also be appreciated that the pivot axis for support arm 72 is spaced apart by a significant distance from the pivot axes for support arms 42 and 44, thereby providing a more even distribution of weight born by cradle 38 across wheeled base 22.

Jack 20 also includes a mechanism for raising and lowering cradle 38. To this end, a standard automotive hydraulic bottle jack 84 is supported upon wheeled base 22. Bottle jack 84 is preferably a ten-inch, twelve-ton capacity hydraulic jack of the type commercially available from Heim Warner. A support base for bottle jack 84 is provided by welding two sections 86 and 88 of two-inch angle iron between the sides of frame 24, the vertical flanges of such angle iron sections 86 and 88 being spaced apart from one another by approximately four inches, and the horizontal flanges of such angle iron sections extending toward one another in a common plane coincident with the lower face of frame 24. In this manner, a platform is provided for supporting bottle jack 84, such platform being located only one or two inches above the ground.

Hydraulic bottle jack 84 includes a piston rod 90 which can be hydraulically extended vertically from the base of bottle jack 84 when lever arm 92 (see FIG. 3) is pumped. Lever arm 92 extends from a peripheral portion of wheeled base 22 proximate the rear end thereof for allowing a user to pump hydraulic fluid, and thereby extend piston rod 90. In order to transfer the upward lifting force of piston rod 90 to cradle 38, a lifting tower 94 is provided. As shown best in FIG. 3, lifting tower 94 is in the form of a yoke that includes an upper member 96 for being engaged by the piston rod, and that includes two opposing downwardly depending side members 100 and 102 extending along opposing sides of hydraulic bottle jack 84 and pivotally coupled to the first and second support arms 42 and 44. Upper member 96 is preferably a central, horizontally-extending, steel channel section having an inverted-U shape. Welded to, and extending downwardly from, channel section 96 is a short stub 98 of one and ½-inch square tube opening downwardly and forming a pocket for receiving the uppermost load-bearing flange of piston rod 90.

Side members 100 and 102 of lifting tower 94 are preferably formed of first and second steel bars which extend downwardly from channel section 96 on opposing sides of bottle jack 84. As shown best in FIG. 1, a pivot bolt and nut assembly 104 extends through aligned holes formed in vertical bar 100 and plates 46 and 48 of support arm 44 to form a pivotal connection therebetween along a lifting pivot axis defined by bolt 104. Likewise, referring to FIGS. 1 and 2, a pivot bolt and nut assembly 106 pivotally couples vertical bar 102 to plates 56 and 58 at the lower end of support arm 42 along a lifting pivot axis coincident with bolt 106. Bolts 104 and 106 lie along a common lifting pivot axis; this common lifting pivot axis lies generally between the pivot axis for the lower end of support arms 42 and 44 (i.e., bolts 52 and 60) and the pivot axis at the upper ends of support arms 42 and 44 (i.e., bolts 68 and 70). Moreover, it should be noted that the pivot axis for the lower end of support arms 42 and 44 (i.e., bolts 52 and 60) and the pivot axis for the lower end of third support arm 72 (i.e., bolt 76) are spaced apart from one another and lie on opposite sides of the common lifting pivot axis (i.e., bolts 104 and 106) to more evenly distribute weight born by the cradle across the wheeled base 22.

As hydraulic bottle jack 84 is manually pumped by lever 92 to raise piston rod 90, lifting tower 94 is elevated, which in turn raises vertical bars 100 and 102. This lifting force is transferred by pivot bolts 104 and 106 to support arms 42 and 44, causing such support arms 42 and 44 to pivot about pivot bolts 52 and 60, and thereby raising cradle 38. Third support arm 72 follows the angular elevation of support arms 42 and 44 as cradle 38 is raised, thereby maintaining cradle 38 in a horizontal position. Alternatively, when the release valve (not shown) of hydraulic bottle jack 84 is opened, piston rod 90 retracts back into jack 84 under the weight of cradle 38 and any load supported thereby, while support arms 42, 44, and 72 drop from an elevated to a lowered position.

As seen best in FIG. 2, the common lifting pivot axis (i.e., bolts 104 and 106) is preferably located at a lower elevation than the pivot axis for the lower end of support arms 42 and 44 (i.e., bolts 52 and 60), in order to help maintain a low profile when jack 20 is collapsed. In addition, the above-described method of pivotally securing support arms 42, 44 and 72 to wheeled base 22 allows such support arms to extend substantially horizontally when piston rod 90 of hydraulic bottle jack 84 is retracted in order to permit jack 20 to assume a low profile when collapsed.

Hydraulic bottle jack 84 is easily replaced or removed for servicing. The user need only raise cradle 38 by hand when cradle 38 is not under load, thereby causing lifting tower 94 to rise above piston rod 90. Bottle jack 84 may then be simply lifted from wheeled base 22 for servicing or replacement.

Wheeled base 22 preferably includes a horizontally disposed handle 108 extending from the front end of frame 24 of wheeled base 22 to aid in maneuvering jack 20. In addition, wheeled base 22 includes a pair of vertically extending handles 110 (see FIG. 2) and 112 (see FIG. 3) secured to vertical tubing sections 62 and 54, respectively. By providing handles at both the front and rear ends of jack 20, a user can more easily position jack 20 below a vehicle in a desired position. In addition, while vertical handles 110 and 112 are disposed generally near hydraulic jack 84, handles 110 and 112 are spaced sufficiently far from bottle jack lever 92 (see FIG. 3) that they do not interfere with the up and down pumping motion of lever 92 when cradle 38 is being raised. Nonetheless, handles 110 and 112 extend outwardly as far as pump lever 92, and thereby help to protect pump lever 92 against damage which might otherwise result were jack 20 to be wheeled against a wall or other obstacle. Moreover, handles 108, 110 and 112 are sufficiently spaced above the floor and from the caster wheels to avoid pinching the mechanic's fingers during operation.

As indicated above, in those instances when the transmission or other load is to be supported upon jack 20 for extended periods of time, it is desirable from a safety standpoint to relieve the hydraulic pressure on bottle jack 84. Accordingly, a so-called "stiff leg", or safety bar, may be provided to lock cradle 38 at various elevations even when hydraulic pressure is relieved from bottle jack 84. Referring to FIG. 1, stiff leg 113 is provided in the form of a steel tube having a first end pivotally connected to support arm 42. The opposing second end of stiff leg 113 includes a telescoping detent member 115 which can be retracted or slightly extended via a clamp knob 117. A series of holes 121 are formed in rectangular frame 24 along the side member thereof proximate support arm 42. Cradle 38 may easily be locked at an elevated position by pivoting stiff leg 113 downwardly toward frame 24 and engaging detent member 115 with one of the holes 121 formed in frame 24. Stiff leg 113 provides an added safety feature against inadvertent collapse of jack 20 should bottle jack 84 fail. When not in use, stiff leg 113 can be retained in a stored position by engaging detent member 115 with a retaining pocket 123 welded to the underside of support arm 42.

Cradle 38 provides features which permit it to safely and securely support a wide variety of transmissions, gearboxes, differentials, and other truck components. Support bar 114 is secured to the front end of cradle 38, and support bar 116 is secured to the opposing rear end of cradle 38. Support bar 114 is a section of square steel tubing; upwardly protruding lips 118 and 120 are welded to each end of support bar 114 to prevent a load from sliding off of support bar 114. Likewise, lips 122 and 124 are welded to support bar 116.

The elevation of support bar 114 relative to cradle 38 can be adjusted. A pair of threaded bolts 126 and 128 extend upwardly through end member 43 of rectangular frame 40 and are threadedly engaged therewith. The extreme ends of bolts 126 and 128 are not threaded, but are smooth, and extend within receiving holes drilled within the underside of support bar 114. The heads of bolts 126 and 128 are accessible below end member 43 and can be rotated with a wrench to raise or lower support bar 114. Similar bolts 130 and 132 are used to adjustably determine the height of support bar 116 above end member 45 of frame 40. Thus, bolts 126, 128, 130, and 132 allow support bars 114 and 116 of cradle 38 to be adjusted to various elevations to adapt to transmissions or gear boxes of different shapes and sizes without requiring wood spacers, shim blocks, or other less safe devices for making such adjustments.

To further adapt cradle 38 to different loads, support bar 114 has a series of holes 134 and 136 formed therein upon the upper face thereof. Likewise, support bar 116 has a series of holes 138 and 140 formed therein upon the upper face thereof. As shown in FIG. 1, one or more locating pins 142 can be inserted into holes 134, 136, 138, and 140 to engage various supporting surfaces of the transmission or gearbox.

Figure 5:
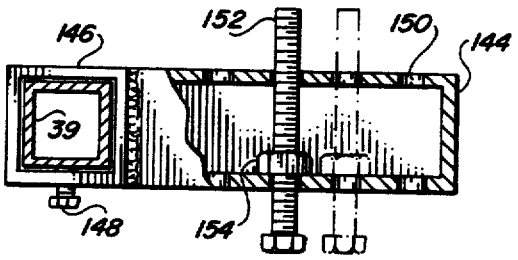
FIG. 5 is a partial sectional view of a sliding support bar releasably secured to the cradle for use in supporting a locator bolt for assisting in the support of a transmission or gear box.

Apart from end support bars 114 and 116, one or more central support bars may also be provided upon cradle 38 to adapt to loads of different configurations. A first central support bar 144 is shown in FIGS. 1 and 5, and includes a square tubular collar 146 having inner dimensions commensurate with the outer dimensions of side member 39 of cradle frame 40. Collar 146 is slidingly engaged with side member 39 for allowing support bar 144 to be slidingly supported thereby. A clamp bolt 148 is threadedly engaged with a threaded hole formed in the lower face of collar 146. Clamp bolt 148 serves as a locking mechanism for selectively locking collar 146 against further sliding movement along side member 39 once collar 146 is positioned in a desired location.

As indicated in FIGS. 1 and 5, a series of holes, such as hole 150, are formed in the upper and lower faces of support bar 144. A locating bolt 152, made of hardened steel, may be inserted into and threadedly engaged with any one of such holes 150 in order to support locating bolt 152 at a plurality of positions along support bar 144 to aid in supporting the transmission or other load. The height of locating bolt 152 can be adjusted by rotating the head of the bolt with a wrench. As indicated in FIG. 5, the threaded engagement between the hole 150 and locating bolt 152 can be made via a threaded nut 154 disposed within support bar 144. A similar central support bar 156 is provided with a collar 158 engaged with the opposing side member 41 of cradle frame 40. Collar 158 can be locked via clamp bolt 160, and support bar 156 can be used in conjunction with a similar locating bolt 162 which can be adjusted as to longitudinal position, lateral position, and height, in accordance with the transmission or other load to be supported.

Figure 4:
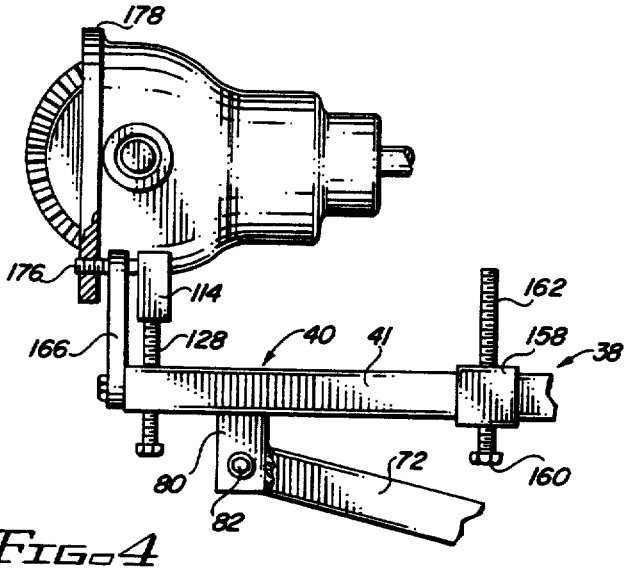
FIG. 4 is a side view of the cradle of the truck transmission jack shown supporting a differential gear casing.

Cradle 38 is easily configured to support differentials, or rear ends. As shown in FIGS. 1, 3, and 4, cradle 38 includes a pair of arms 164 and 166 secured to the forward end member 43 or cradle frame 40. Arm 164 has a slot 168 formed therein, and attachment bolt 170 extends through slot 168 and secures arm 164 to frame 40. When not in use, arm 164 can be pivoted to extend horizontally, as shown in FIG. 1. However, when jack 20 is to be used to support a differential assembly, arm 164 is pivoted to extend upwardly. Bolt 170 can be loosened to permit arm 164 to be raised or lowered via slot 168 before retightening bolt 170. The end of arm 164 opposite attachment bolt 170 has a hole 172 formed therein; arm 166 has a similar hole 174. As shown in FIG. 4, a bolt 176 is extended through hole 174 of arm 166 and into the casing 178 of the differential in order to help releasably secure the differential upon cradle 38 of jack 20.

Those skilled in the art will now appreciate that a simple and inexpensive truck transmission jack has been described which is adapted to maintain a low profile when collapsed, but which is capable of being extended to a significant elevation without becoming unsafe or unstable; using the dimensions specified herein, the present inventor has constructed such a jack which can position the cradle at an elevation anywhere between 9 inches and 36 inches above the ground without becoming unstable under load. The transmission jack is capable of using a standard vertical hydraulic bottle jack that is easily removable for servicing or replacement. The support arms are spaced sufficiently apart from one another to evenly and safely distribute weight born by the cradle to the underlying wheeled base. The handles allow easy maneuverability of the transmission jack without interfering with the operation of the bottle jack pump lever. Finally, the cradle is easily adjustable to match the contour of a wide variety of transmissions, gear boxes, differentials, without requiring chains to secure the load to the cradle.

While the present invention has been described with respect to the preferred embodiment thereof, such description is for illustrative purposes only, and is not to be construed as limiting the scope of the invention. Various modifications and changes may be made to the described embodiment by those skilled in the art without departing from the true spirit and scope of the invention as defined by the appended claims.

I claim:

1. A lifting device for supporting transmissions and gear boxes of vehicles, said lifting device comprising in combination:

a. a wheeled base for allowing said lifting device to be moved into a desired position under a vehicle;

b. a cradle for engaging and supporting the underside of a transmission or gear box;

c. first and second support arms each having first and second opposing ends, the first ends of said first and second support arms being pivotally coupled to said base along a first pivot axis, and the second ends of said first and second support arms being pivotally coupled to said cradle along a second pivot axis, said first and second support arms extending parallel to each other generally along opposing sides of said wheeled base;

d. a hydraulic jack supported vertically upon said base, said hydraulic jack having a piston rod selectively extendable upwardly therefrom;

e. lifting means engaged by said piston rod for being raised and lowered thereby, said lifting means being pivotally coupled to said first and second support arms along a third pivot axis located generally between said first pivot axis and said second pivot axis; and f. at least a third support arm having first and second opposing ends, the first end of said third support arm being pivotally coupled to said base along a fourth pivot axis, and the second end of said third support arm being pivotally coupled to said cradle along a fifth pivot axis, said first and fourth pivot axes being spaced apart from one another and lying on opposite sides of said third pivot axis to more evenly distribute weight born by said cradle across said wheeled base, said third support arm extending generally parallel to said first and second support arms for maintaining said cradle in a relatively horizontal position.

2. A lifting device as recited by claim 1 wherein said hydraulic jack is a manually-operated bottle jack.

3. A lifting device as recited by claim 1 wherein said first, second, and third support arms extend substantially horizontally when said hydraulic jack piston rod is retracted in order to permit said lifting device to assume a low profile when collapsed.

4. A lifting device as recited by claim 1 wherein said third support arm rotates through a plane that is substantially centered between said first and second support arms.

5. A lifting device as recited by claim 1 wherein said lifting means is a yoke including an upper member for being engaged by the piston rod, and including two opposing downwardly depending side members extending along opposing sides of said hydraulic jack and pivotally coupled to said first and second support arms along the third pivotal axis.

6. A lifting device as recited by claim 5 wherein said hydraulic jack is a manually-operated bottle jack removably placed between said wheeled base and the upper member of said yoke.

7. A lifting device as recited by claim 1 wherein said cradle includes a generally rectangular frame having first and second opposing side members and first and second opposing end members, said first and second support arms being pivotally coupled along the second pivotal axis to said first and second opposing side members, respectively.

8. A lifting device as recited by claim 7 wherein said cradle includes a first support bar secured above said first end member and a second support bar secured above said second end member, each of said first and second support bars being adjustable in height to vary the height of each of said support bars above its respective end member in order to adapt to transmissions or gear boxes of different shapes and sizes.

9. A lifting device as recited by claim 8 wherein at least one of said support bars includes holes formed therein for receiving locating pins used to help support a transmission or gear box.

10. A lifting device as recited by claim 1 wherein at least one fastening arm is secured to said cradle, said fastening arm having a hole formed therein for receiving a bolt used to releasably secure a differential or other load to the cradle.

11. A lifting device as recited by claim 9 wherein said at least one support bar includes a plurality of holes formed therein for supporting said locator bolt at a plurality of positions along said at least one support bar.

12. A lifting device as recited by claim 11 wherein said at least one support bar includes a collar slidingly engaged with a side member of said cradle, said collar including locking means for selectively locking said collar against further sliding movement along the side member of said cradle.

13. A lifting device as recited by claim 1 wherein said base includes handles secured to opposing ends of said base for allowing a user to easily position said lifting device.

14. A lifting device as recited by claim 1 wherein said hydraulic jack includes a pump lever extending from a peripheral portion of said wheeled base for allowing a user to pump hydraulic fluid in order to extend said piston rod, said lifting device further including at least one handle secured to said wheeled base proximate said hydraulic jack for positioning said lifting device below a vehicle, said handle being spaced apart from said pump lever to avoid interference therewith.

15. A lifting device for supporting transmissions and gear boxes of vehicles, said lifting device comprising in combination:

a. a wheeled base for allowing said lifting device to be moved into a desired position under a vehicle;

b. a cradle for engaging and supporting the underside of a transmission or gear box;

c. first and second support arms each having first and second opposing ends, the first ends of said first and second support arms being pivotally coupled to said base along a first pivot axis, and the second ends of said first and second support arms being pivotally coupled to said cradle along a second pivot axis, said first and second support arms extending parallel to each other generally along opposing sides of said wheeled base;

d. a hydraulic jack supported vertically upon said base, said hydraulic jack having a piston rod selectively extendable upwardly therefrom;

e. lifting means engaged by said piston rod for being raised and lowered thereby, said lifting means being pivotally coupled to said first and second support arms along a third pivot axis located generally between said first pivot axis and said second pivot axis, said third pivot axis being generally at a lower elevation than said first pivot axis; and f. at least a third support arm having first and second opposing ends, the first end of said third support arm being pivotally coupled to said base along a fourth pivot axis, and the second end of said third support arm being pivotally coupled to said cradle along a fifth pivot axis, said first and fourth pivot axes being spaced apart from one another and lying on opposite sides of said third pivot axis to more evenly distribute weight born by said cradle across said wheeled base, said third support arm extending generally parallel to said first and second support arms for maintaining said cradle in a relatively horizontal position.

16. A lifting device for supporting transmissions and gear boxes of vehicles, said lifting device comprising in combination:

a. a wheeled base for allowing said lifting device to be moved into a desired position under a vehicle;

b. a cradle for engaging and supporting the underside of a transmission or gear box, said cradle including a generally rectangular frame having first and second opposing side members and first and second opposing end members;

c. first and second support arms each having first and second opposing ends, the first ends of said first and second support arms being pivotally coupled to said base along a first pivot axis, and the second ends of said first and second support arms being pivotally coupled to said first and second opposing side members, respectively, of said cradle along a second pivot axis said first and second support arms extending parallel to each other generally along opposing sides of said wheeled base;

d. a hydraulic jack supported vertically upon said base, said hydraulic jack having a piston rod selectively extendable upwardly therefrom;

e. lifting means engaged by said piston rod for being raised and lowered thereby, said lifting means being pivotally coupled to said first and second support arms along a third pivot axis located generally between said first pivot axis and said second pivot axis; and f. at least a third support arm having first and second opposing ends, the first end of said third support arm being pivotally coupled to said base along a fourth pivot axis, and the second end of said third support arm being pivotally coupled to said cradle along a fifth pivot axis, said first and fourth pivot axes being spaced apart from one another and lying on opposite sides of said third pivot axis to more evenly distribute weight born by said cradle across said wheeled base, said third support arm extending generally parallel to said first and second support arms for maintaining said cradle in a relatively horizontal position.

* * * * *